US008558746B2

(12) United States Patent
Thomson et al.

(10) Patent No.: US 8,558,746 B2
(45) Date of Patent: Oct. 15, 2013

(54) FLAT PANEL ARRAY ANTENNA

(75) Inventors: Alexander P Thomson, Livingston (GB); Claudio Biancotto, Edinburgh (GB); Christopher D Hills, Glenrothes (GB)

(73) Assignee: Andrew LLC, Hickory, NC (US)

( * ) Notice: Subject to any disclaimer, the term of this patent is extended or adjusted under 35 U.S.C. 154(b) by 222 days.

(21) Appl. No.: 13/297,304

(22) Filed: Nov. 16, 2011

(65) Prior Publication Data

US 2013/0120205 A1 May 16, 2013

(51) Int. Cl.
*H01Q 13/00* (2006.01)

(52) U.S. Cl.
USPC ..... 343/776; 343/770; 343/771; 29/600

(58) Field of Classification Search
USPC ..... 343/776, 770, 771; 29/600
See application file for complete search history.

(56) References Cited

U.S. PATENT DOCUMENTS

| | | | |
|---|---|---|---|
| 2,573,746 | A | 11/1951 | Watson et al. |
| 2,981,948 | A | 4/1961 | Kurtz |
| 3,157,847 | A | 11/1964 | Williams |
| 3,193,830 | A | 7/1965 | Provencher |
| 3,243,818 | A | 3/1966 | Holtzman |
| 3,281,851 | A | 10/1966 | Goebels, Jr. |
| 3,340,534 | A | 9/1967 | Fee |
| 3,570,007 | A | 3/1971 | Whitehead |
| 3,599,216 | A | 8/1971 | Paine et al. |
| 3,701,162 | A | 10/1972 | Seaton |
| 4,121,220 | A | 10/1978 | Scillieri et al. |
| 4,429,313 | A | 1/1984 | Muhs, Jr. et al. |
| 4,527,165 | A | 7/1985 | de Ronde |
| 4,716,415 | A | 12/1987 | Kelly |
| 4,829,309 | A | 5/1989 | Tsukamoto et al. |
| 4,857,938 | A | 8/1989 | Tsukamoto et al. |

(Continued)

FOREIGN PATENT DOCUMENTS

| | | | |
|---|---|---|---|
| CN | 1885616 | A * | 12/2006 |
| EP | 0154240 | A2 | 9/1985 |

(Continued)

OTHER PUBLICATIONS

Miura et al, Double-Layer Full-Corporate-Feed Hollow-Waveguide Slot Array Antenna in the 60-GHz Band, Aug. 2011, IEEE Transactions on Antennas and Propagation, vol. 59, No. 8, pp. 2844-2851.*

(Continued)

*Primary Examiner* — Dieu H Duong
(74) *Attorney, Agent, or Firm* — Babcock IP, PLLC

(57) ABSTRACT

A panel array antenna has a waveguide network coupling an input feed to a plurality of primary coupling cavities. Each of the primary coupling cavities is provided with four output ports, each of the output ports coupled to a horn radiator. The waveguide network is provided on a second side of an input layer and a first side of a first intermediate layer. The primary coupling cavities are provided on a second side of the first intermediate layer and the output ports provided on a first side of an output layer, each of the output ports in communication with one of the horn radiators. The horn radiators are provided as an array of horn radiators on a second side of the output layer. Additional layers, such as a second intermediate layer and/or slot layer, may also be applied, for example to further simplify the waveguide network and/or rotate the polarization.

20 Claims, 18 Drawing Sheets

(56) References Cited

U.S. PATENT DOCUMENTS

| | | | | |
|---|---|---|---|---|
| 4,878,060 | A | 10/1989 | Barbier et al. | |
| 4,916,458 | A | 4/1990 | Goto | |
| 4,949,092 | A | 8/1990 | Crail et al. | |
| 4,959,658 | A | 9/1990 | Collins | |
| 4,985,708 | A | 1/1991 | Kelly | |
| 5,010,351 | A | 4/1991 | Kelly | |
| 5,019,831 | A | 5/1991 | Yee et al. | |
| 5,086,304 | A | 2/1992 | Collins | |
| 5,210,543 | A | 5/1993 | Kurtz | |
| 5,243,354 | A | 9/1993 | Stern et al. | |
| 5,270,721 | A | 12/1993 | Tsukamoto et al. | |
| 5,321,411 | A | 6/1994 | Tsukamoto et al. | |
| 5,327,150 | A | 7/1994 | Cherrette | |
| 5,512,906 | A | 4/1996 | Speciale | |
| 5,541,612 | A | 7/1996 | Josefsson | |
| 5,579,019 | A | 11/1996 | Uematsu et al. | |
| 5,589,843 | A | 12/1996 | Meredith et al. | |
| 5,619,216 | A | 4/1997 | Park | |
| 5,650,793 | A | 7/1997 | Park | |
| 5,831,583 | A | 11/1998 | Lagerstedt et al. | |
| 5,880,695 | A | 3/1999 | Brown et al. | |
| 5,926,147 | A | 7/1999 | Sehm et al. | |
| 6,023,243 | A | 2/2000 | Frank | |
| 6,101,705 | A | 8/2000 | Wolfson et al. | |
| 6,127,985 | A | 10/2000 | Guler | |
| 6,198,456 | B1 | 3/2001 | Le Halle et al. | |
| 6,201,508 | B1 | 3/2001 | Metzen et al. | |
| 6,225,960 | B1 | 5/2001 | Collins | |
| 6,285,335 | B1 | 9/2001 | Snygg et al. | |
| 6,304,228 | B1 | 10/2001 | Smith et al. | |
| 6,476,772 | B1 | 11/2002 | Smith et al. | |
| 6,480,167 | B2 | 11/2002 | Matthews | |
| 6,535,173 | B2 | 3/2003 | Ou | |
| 6,563,398 | B1 * | 5/2003 | Wu | 333/137 |
| 6,624,787 | B2 | 9/2003 | Puzella et al. | |
| 6,657,599 | B2 | 12/2003 | Solbach | |
| 6,720,931 | B1 | 4/2004 | Michisaka et al. | |
| 6,731,241 | B2 | 5/2004 | Park et al. | |
| 6,796,126 | B2 | 9/2004 | Hasegawa et al. | |
| 6,861,996 | B2 | 3/2005 | Jeong | |
| 6,950,066 | B2 | 9/2005 | Hendler et al. | |
| 6,977,621 | B2 | 12/2005 | Kelly et al. | |
| 7,064,725 | B2 | 6/2006 | Shtrikman et al. | |
| 7,205,948 | B2 | 4/2007 | Krikorian et al. | |
| 7,227,508 | B2 | 6/2007 | Wang et al. | |
| 7,391,381 | B2 | 6/2008 | Wang et al. | |
| D576,344 | S | 9/2008 | Conroy | |
| 7,607,942 | B1 | 10/2009 | Van Swearingen | |
| 7,663,566 | B2 | 2/2010 | Engel | |
| 7,680,516 | B2 | 3/2010 | Lovberg et al. | |
| 7,817,097 | B2 | 10/2010 | Margomenos | |
| 7,872,609 | B2 * | 1/2011 | Ou et al. | 343/776 |
| 7,948,443 | B2 | 5/2011 | Bullock et al. | |
| 8,010,042 | B2 | 8/2011 | Judd et al. | |
| 8,040,286 | B2 | 10/2011 | Matsuo et al. | |
| 2004/0233122 | A1 | 11/2004 | Espenscheid et al. | |

FOREIGN PATENT DOCUMENTS

| | | | |
|---|---|---|---|
| EP | 0205212 | A1 | 12/1986 |
| EP | 0213646 | A1 | 3/1987 |
| EP | 2083484 | A2 | 7/2009 |
| FR | 2669776 | A1 | 3/1987 |
| GB | 1019474 | A | 2/1966 |
| GB | 2076230 | A | 11/1981 |
| GB | 2142476 | A | 1/1985 |
| SU | 1264257 | A1 | 10/1986 |
| SU | 1587612 | A1 | 8/1990 |
| WO | WO8909501 | A1 | 10/1989 |
| WO | WO9639730 | A1 | 12/1996 |
| WO | WO2009/093779 | | 7/2009 |

OTHER PUBLICATIONS

Byeon Jong Gil, International Search Report of Counterpart International Application No. PCT/IB2013/052989, Jan. 20, 2013, Daejeon Metropolitan City, Korea.

* cited by examiner

FLAT PANEL ARRAY ANTENNA

BACKGROUND

1. Field of the Invention

This invention relates to a microwave antenna. More particularly, the invention provides a flat panel array antenna utilizing cavity coupling to simplify corporate feed network requirements.

2. Description of Related Art

Flat panel array antenna technology has not been extensively applied within the licensed commercial microwave point to point or point to multipoint market, where more stringent electromagnetic radiation envelope characteristics consistent with efficient spectrum management are common. Antenna solutions derived from traditional reflector antenna configurations such as prime focus fed axi-symmetric geometries provide high levels of antenna directivity and gain at relatively low cost. However, the extensive structure of a reflector dish and associated feed may require significantly enhanced support structure to withstand wind loads, which may increase overall costs. Further, the increased size of reflector antenna assemblies and the support structure required may be viewed as a visual blight.

Array antennas typically utilize either printed circuit technology or waveguide technology. The components of the array which interface with free-space, known as the elements, typically utilize microstrip geometries, such as patches, dipoles or slots, or waveguide components such as horns, or slots respectively. The various elements are interconnected by a feed network, so that the resulting electromagnetic radiation characteristics of the antenna conform to desired characteristics, such as the antenna beam pointing direction, directivity, and sidelobe distribution.

Flat panel arrays may be formed, for example, using waveguide or printed slot arrays in either resonant or travelling wave configurations. Resonant configurations typically cannot achieve the requisite electromagnetic characteristics over the bandwidths utilized in the terrestrial point-to-point market sector, whilst travelling wave arrays typically provide a mainbeam radiation pattern which moves in angular position with frequency. Because terrestrial point to point communications generally operate with Go/Return channels spaced over different parts of the frequency band being utilized, movement of the mainbeam with respect to frequency may prevent simultaneous efficient alignment of the link for both channels.

Corporate fed waveguide or slot elements may enable fixed beam antennas exhibiting suitable characteristics. However, it may be necessary to select an element spacing which is generally less than one wavelength, in order to avoid the generation of secondary beams known as grating lobes, which do not respect regulatory requirements, and detract from the antenna efficiency. This close element spacing may conflict with the feed network dimensions. For example, in order to accommodate impedance matching and/or phase equalisation, a larger element spacing is required to provide sufficient volume to accommodate not only the feed network, but also sufficient material for electrical and mechanical wall contact between adjacent transmission lines (thereby isolating adjacent lines and preventing un-wanted interline coupling/cross-talk).

The elements of antenna arrays may be characterized by the array dimensions, such as a $2^N \times 2^M$ element array where N and M are integers. In a typical N×M corporate fed array, (N×M)1 T-type power dividers may be required, along with N×M feed bends and multiple N×M stepped transitions in order to provide acceptable VSWR performance. Thereby, the feed network requirements may be a limiting factor of space efficient corporate fed flat panel arrays.

Therefore it is the object of the invention to provide an apparatus that overcomes limitations in the prior art, and in so doing present a solution that allows such a flat panel antenna to provide electrical performance approaching that of much larger traditional reflector antennas which meet the most stringent electrical specifications over the operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
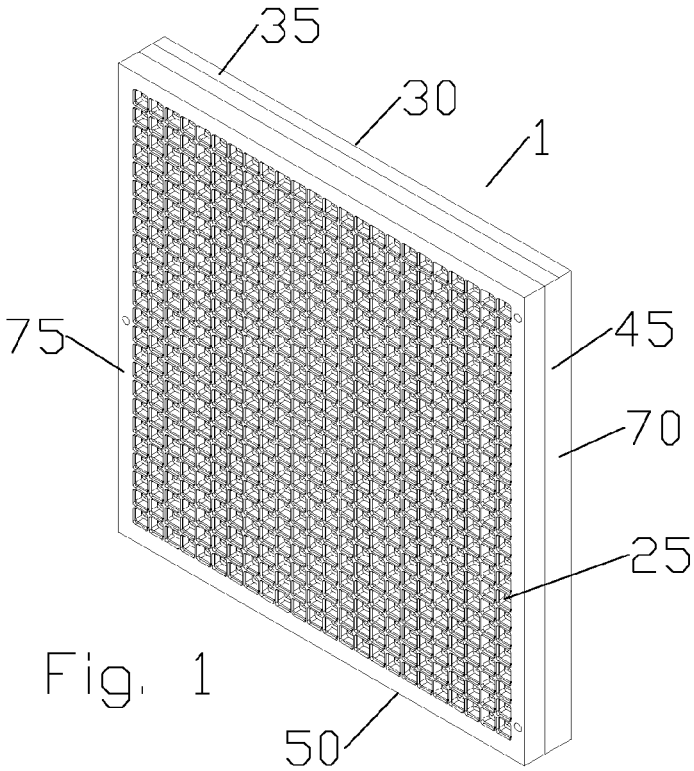
FIG. 1 is a schematic isometric angled front view of an exemplary flat panel antenna.
Figure 2:
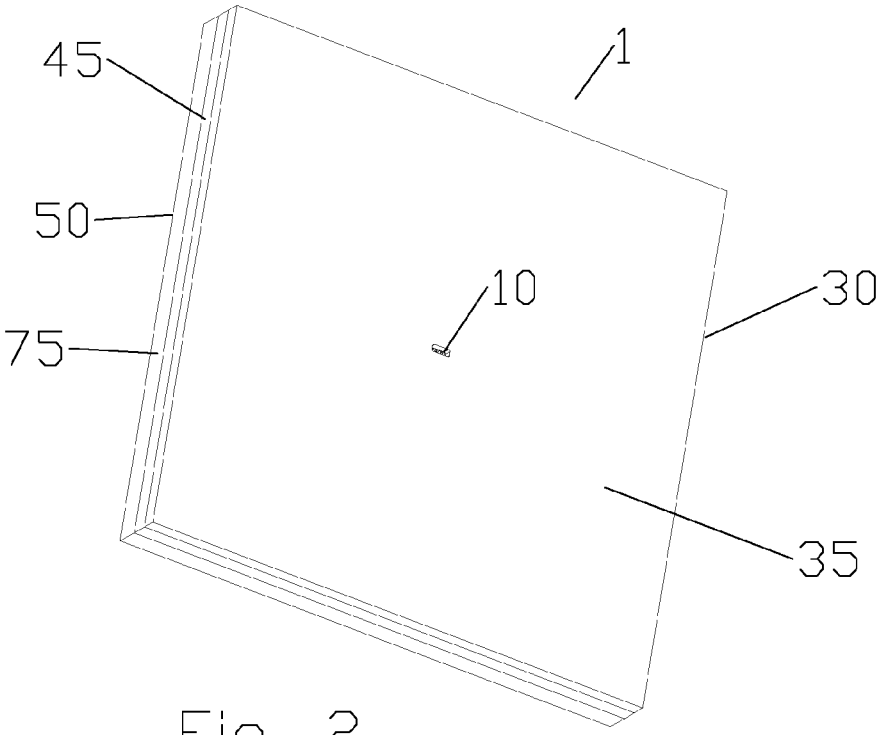
FIG. 2 is a schematic isometric angled back view of the flat panel antenna of FIG. 1.

The inventors have developed a flat panel antenna utilizing a corporate waveguide network and cavity couplers provided in stacked layers. The low loss 4-way coupling of each cavity coupler significantly simplifies the requirements of the corporate waveguide network, enabling higher feed horn density for improved electrical performance. The layered configuration enables cost efficient precision mass production.

As shown in FIGS. 1-8, a first embodiment of a flat panel array antenna 1 is formed from several layers each with surface contours and apertures combining to form a feed horn array 4 and RF path comprising a series of enclosed coupling cavities and interconnecting waveguides when the layers are stacked upon one another.

The RF path comprises a waveguide network 5 coupling an input feed 10 to a plurality of primary coupling cavities 15. Each of the primary coupling cavities 15 is provided with four output ports 20, each of the output ports 20 coupled to a horn radiator 25.

Figure 25:
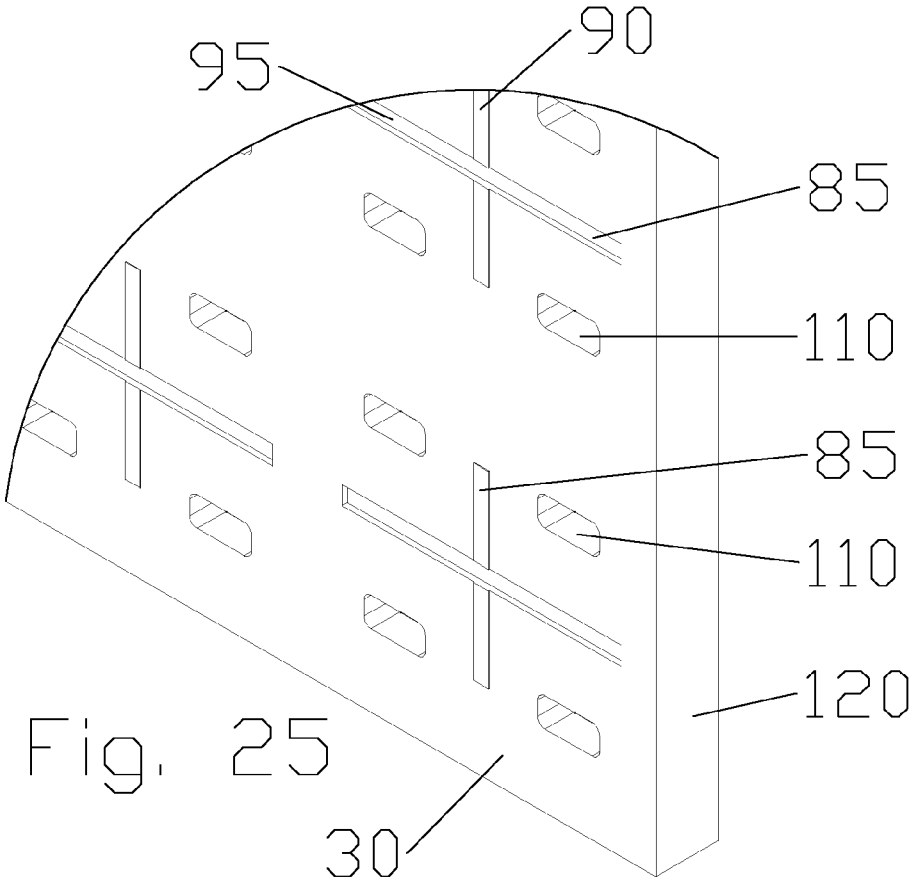
FIG. 25 is a schematic isometric close-up view of the first side of an alternative second intermediate layer.

The input feed 10 is demonstrated positioned generally central on a first side 30 of an input layer 35, for example to allow compact mounting of a microwave transceiver thereto, using antenna mounting features (not shown) interchangeable with those used with traditional reflector antennas. Alternatively, the input feed 10 may be positioned at a layer sidewall 40, as shown for example on FIG. 25, between the input layer 35 and a first intermediate layer 45 enabling, for example, an antenna side by side with the transceiver configuration where the depth of the resulting flat panel antenna assembly is minimized.

Figure 3:
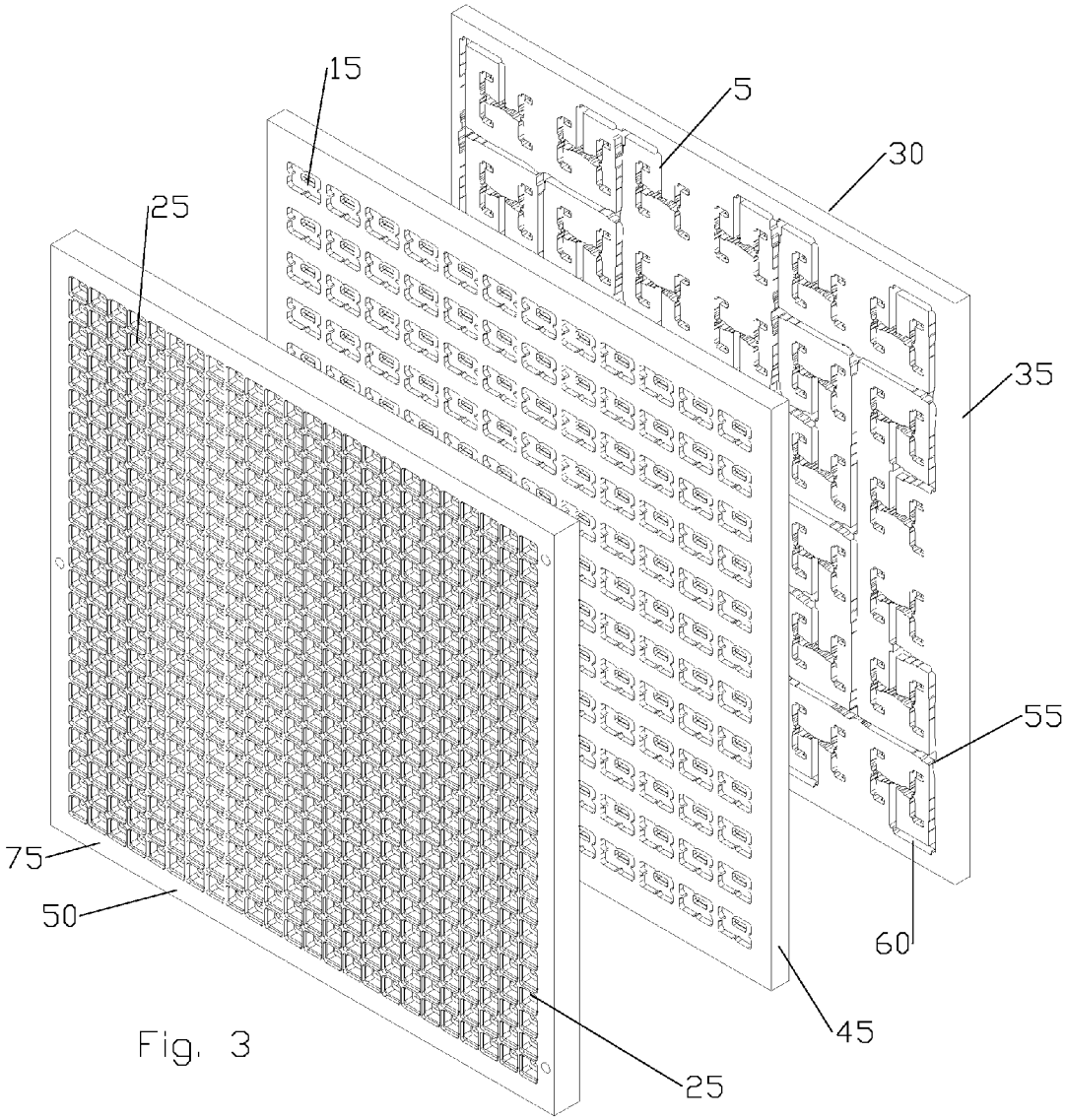
FIG. 3 is a schematic isometric exploded view of FIG. 1.
Figure 4:
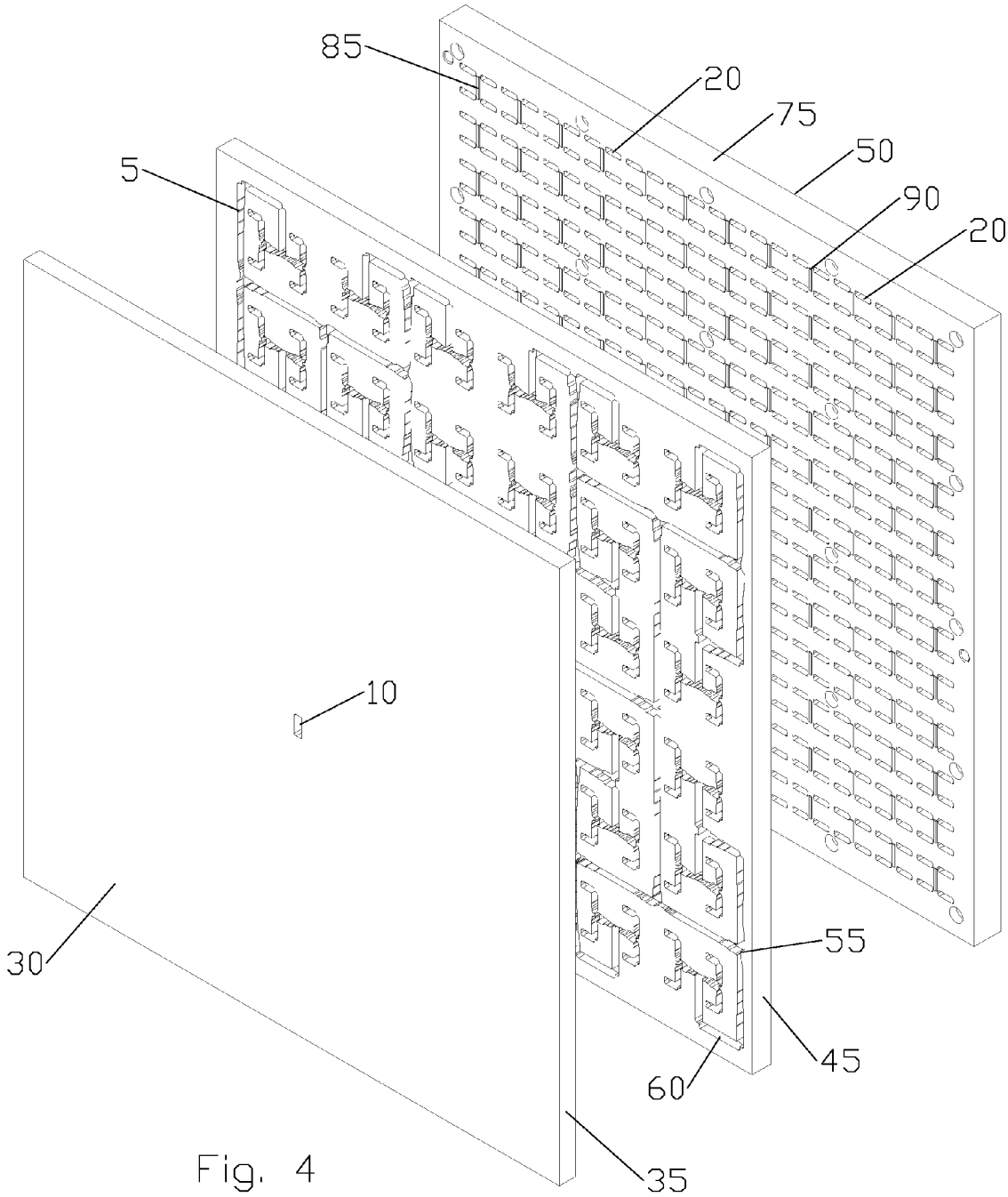
FIG. 4 is a schematic isometric exploded view of FIG. 2.
Figure 5:
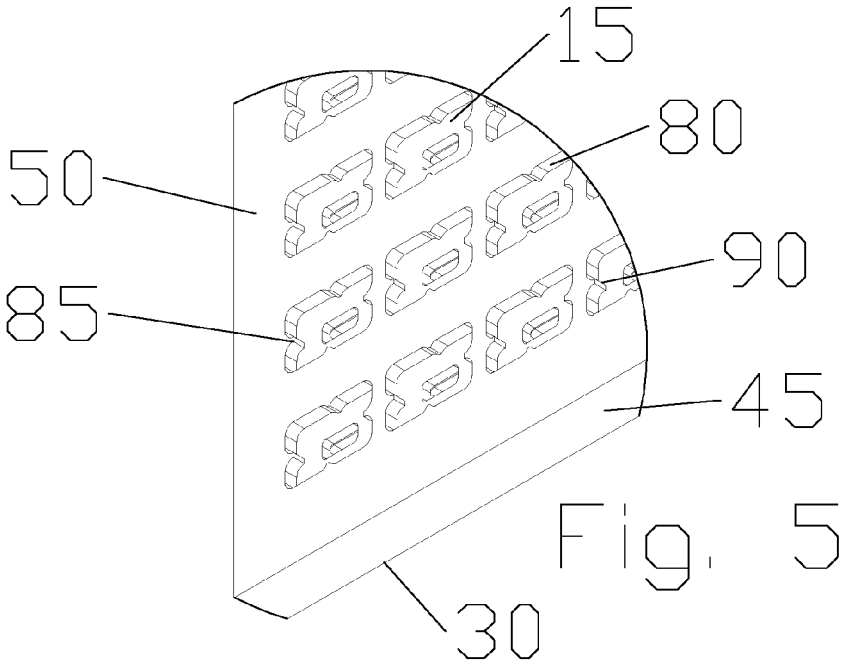
FIG. 5 is a close-up view of the second side of the intermediate layer of FIG. 3.
Figure 6:
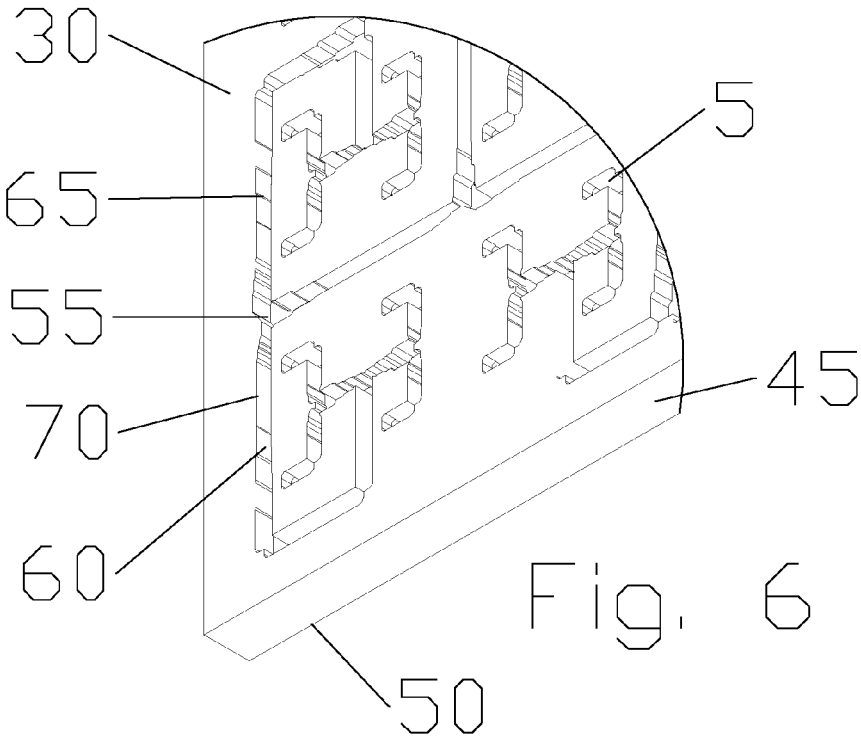
FIG. 6 is a close-up view of the first side of the intermediate layer of FIG. 3.
Figure 7:
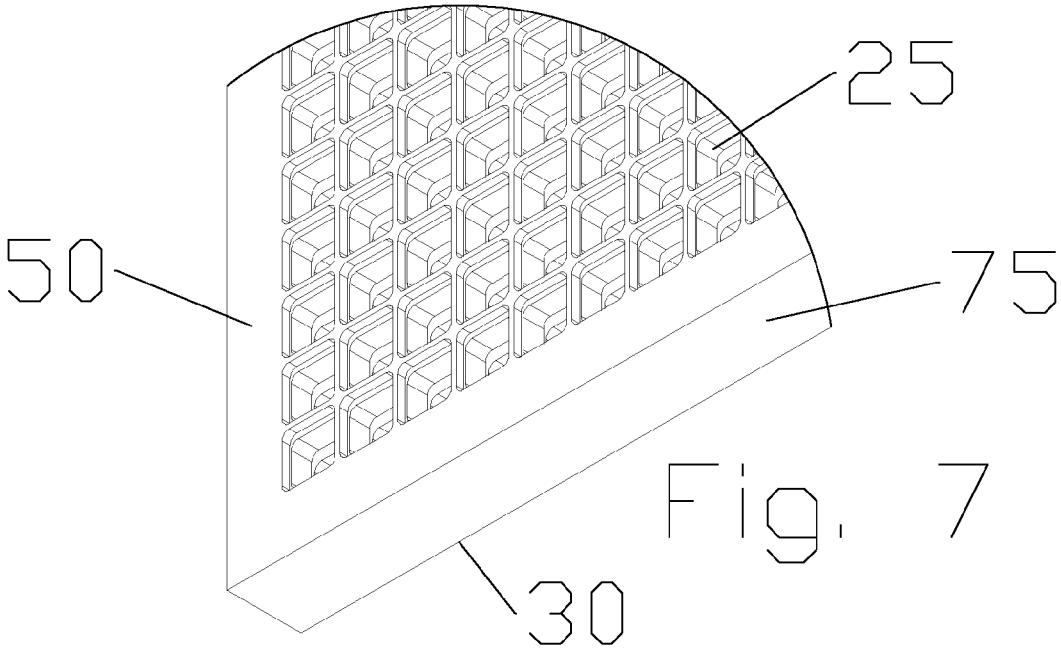
FIG. 7 is a close-up view of the second side of the output layer of FIG. 3.
Figure 8:
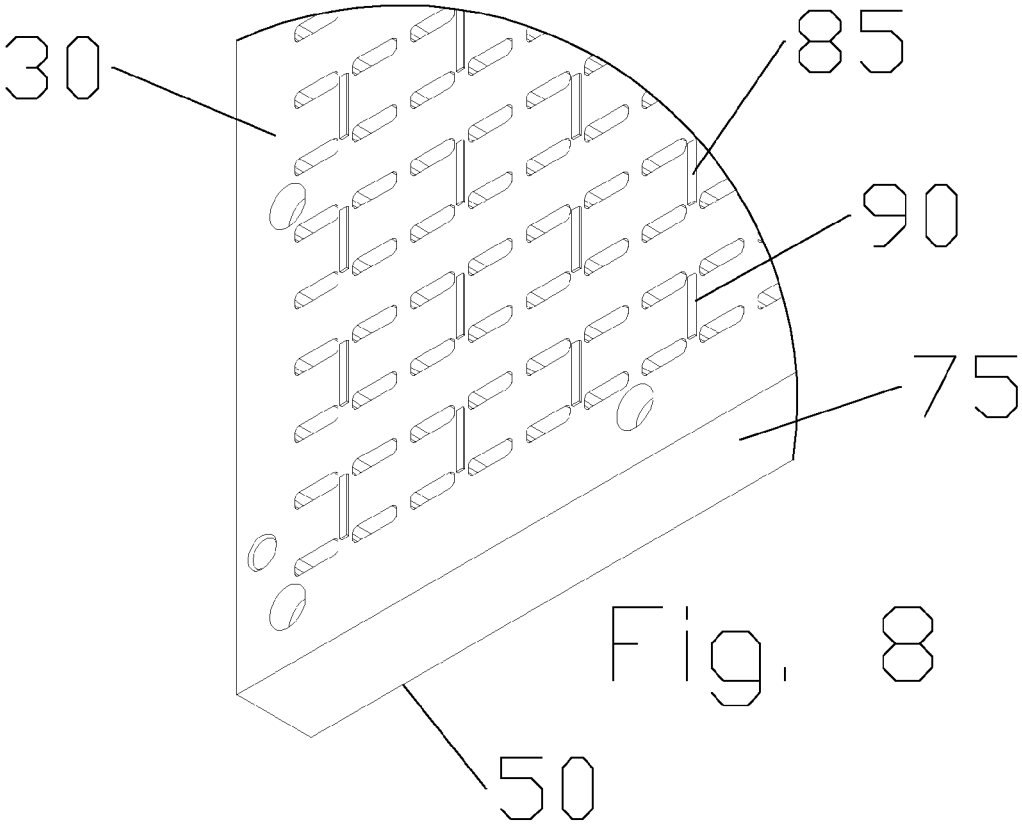
FIG. 8 is a close-up view of the first side of the output layer of FIG. 3.

As best shown on FIGS. 3, 4 and 6, the waveguide network 5 is demonstrated provided on a second side 50 of the input layer 35 and a first side 30 of the first intermediate layer 45. The waveguide network 5 distributes the RF signals to and from the input feed 10 to a plurality of primary coupling cavities 15 provided on a second side 50 of the first intermediate layer 45. The waveguide network 5 may be dimensioned to provide an equivalent length electrical path to each primary coupling cavity 55 to ensure common phase and amplitude. T-type power dividers 55 may be applied to repeatedly divide the input feed 10 for routing to each of the primary coupling cavities 15. The waveguide sidewalls 60 of the waveguide network may also be provided with surface features 65 for impedance matching, filters and/or attenuation.

Figure 9:
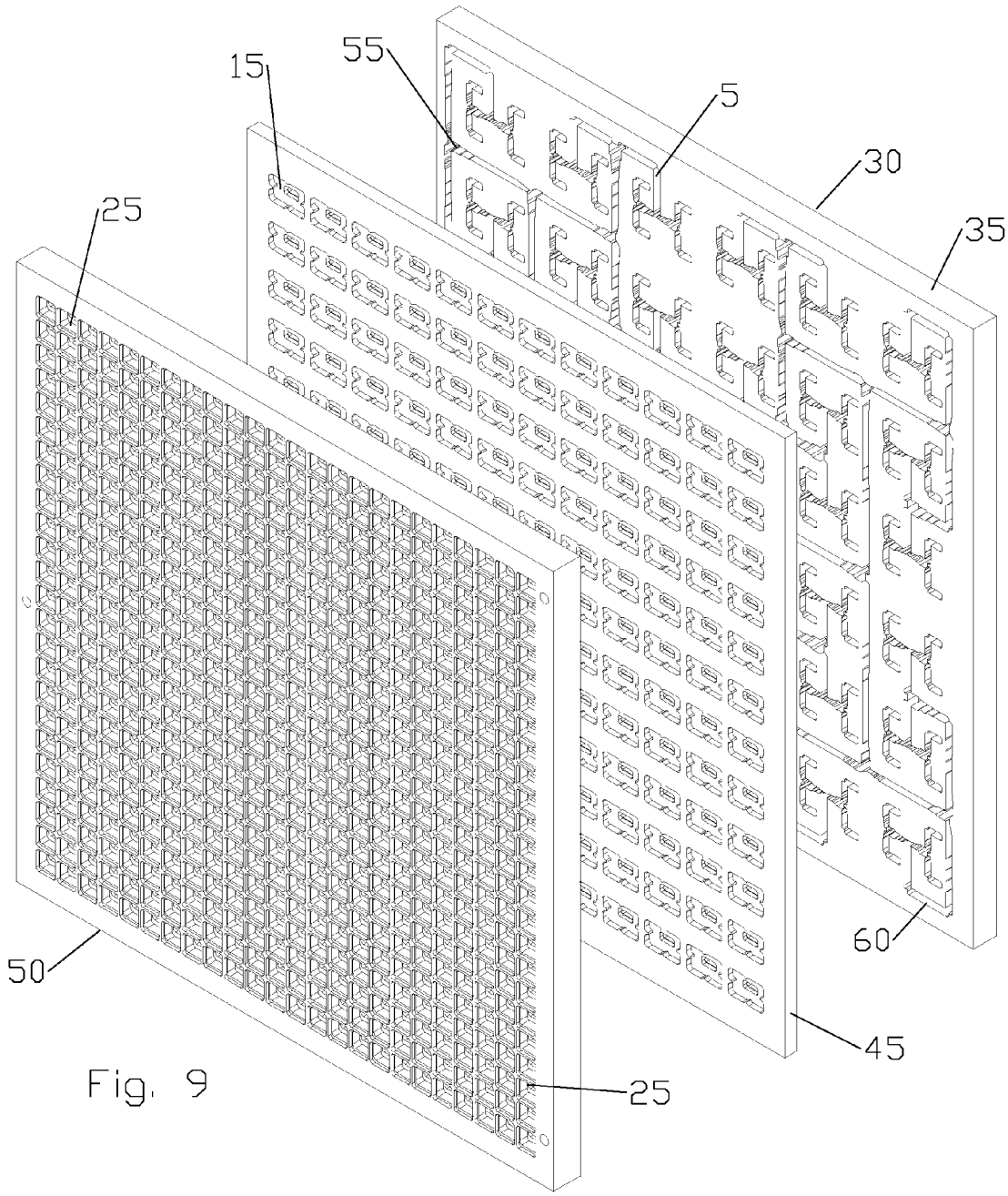
FIG. 9 is a schematic isometric angled front view of an alternative waveguide network embodiment of a flat panel antenna.
Figure 10:
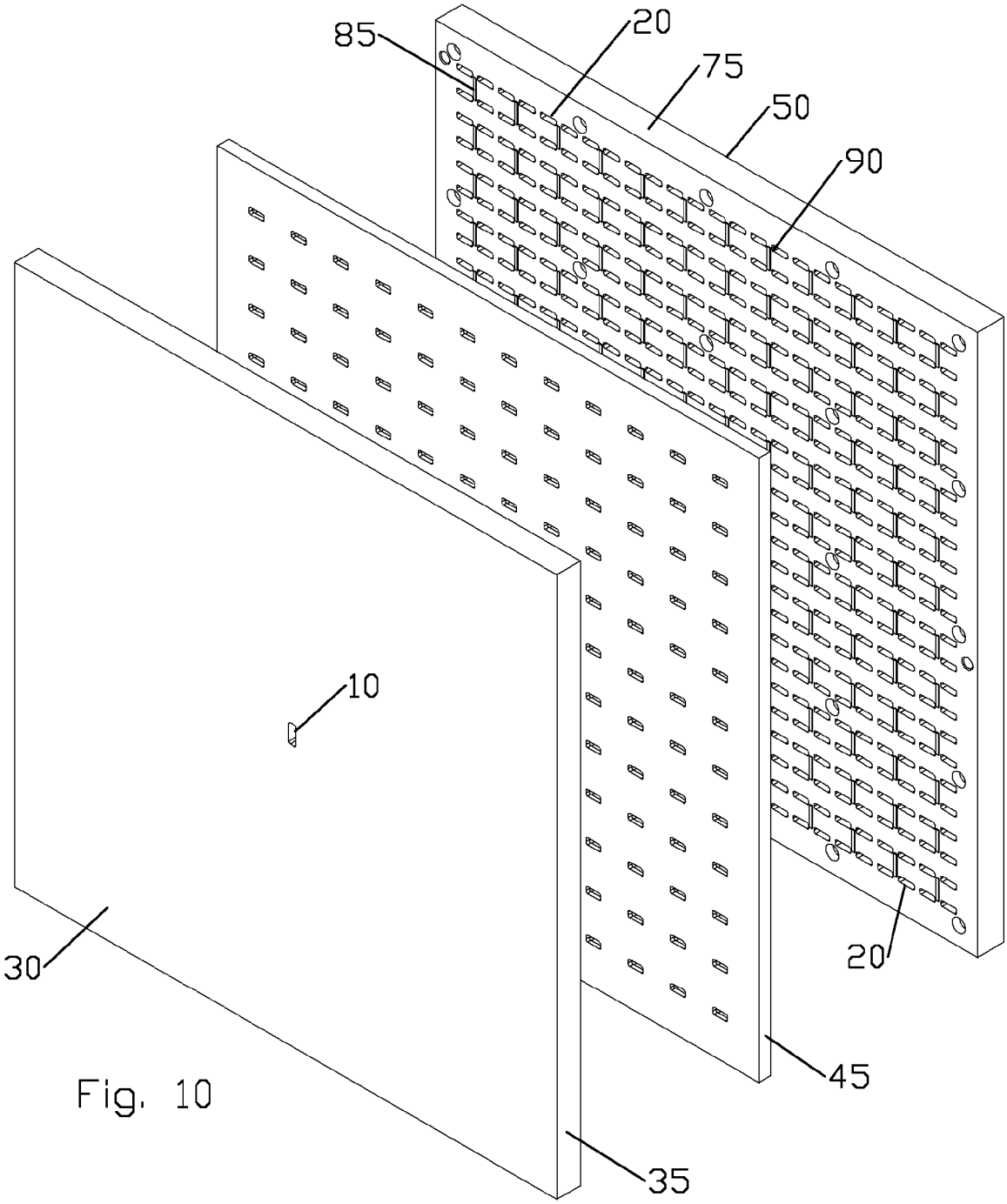
FIG. 10 is a schematic isometric angled back view of the flat panel antenna of FIG. 9.
Figure 11:
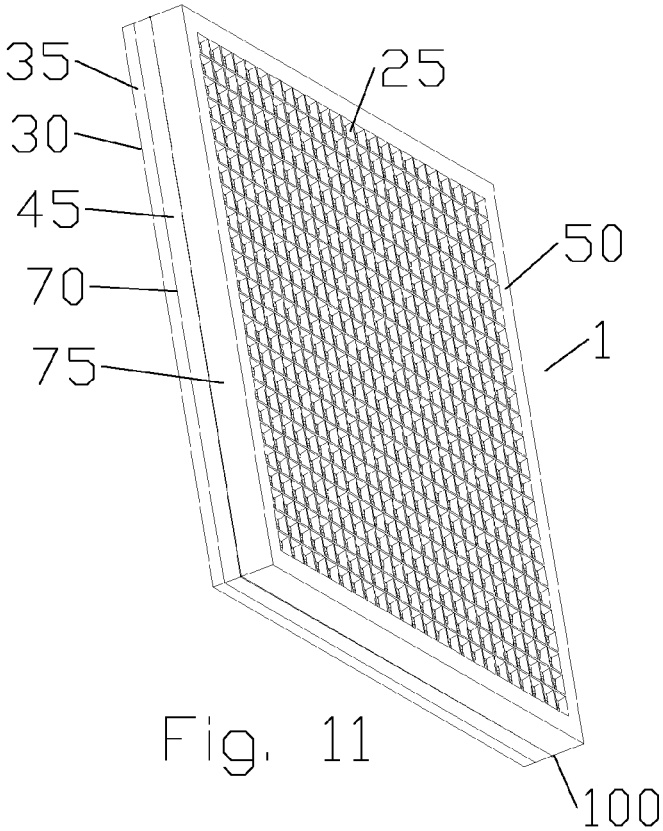
FIG. 11 is a schematic isometric angled front view of an exemplary rotated polarization embodiment of a flat panel antenna.
Figure 12:
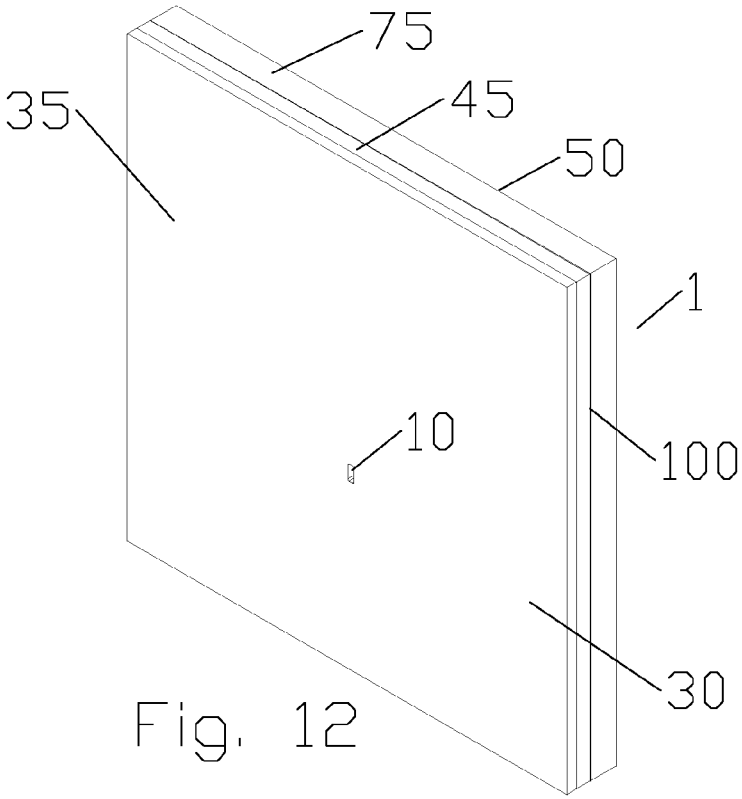
FIG. 12 is a schematic isometric angled back view of the flat panel antenna of FIG. 11.
Figure 13:
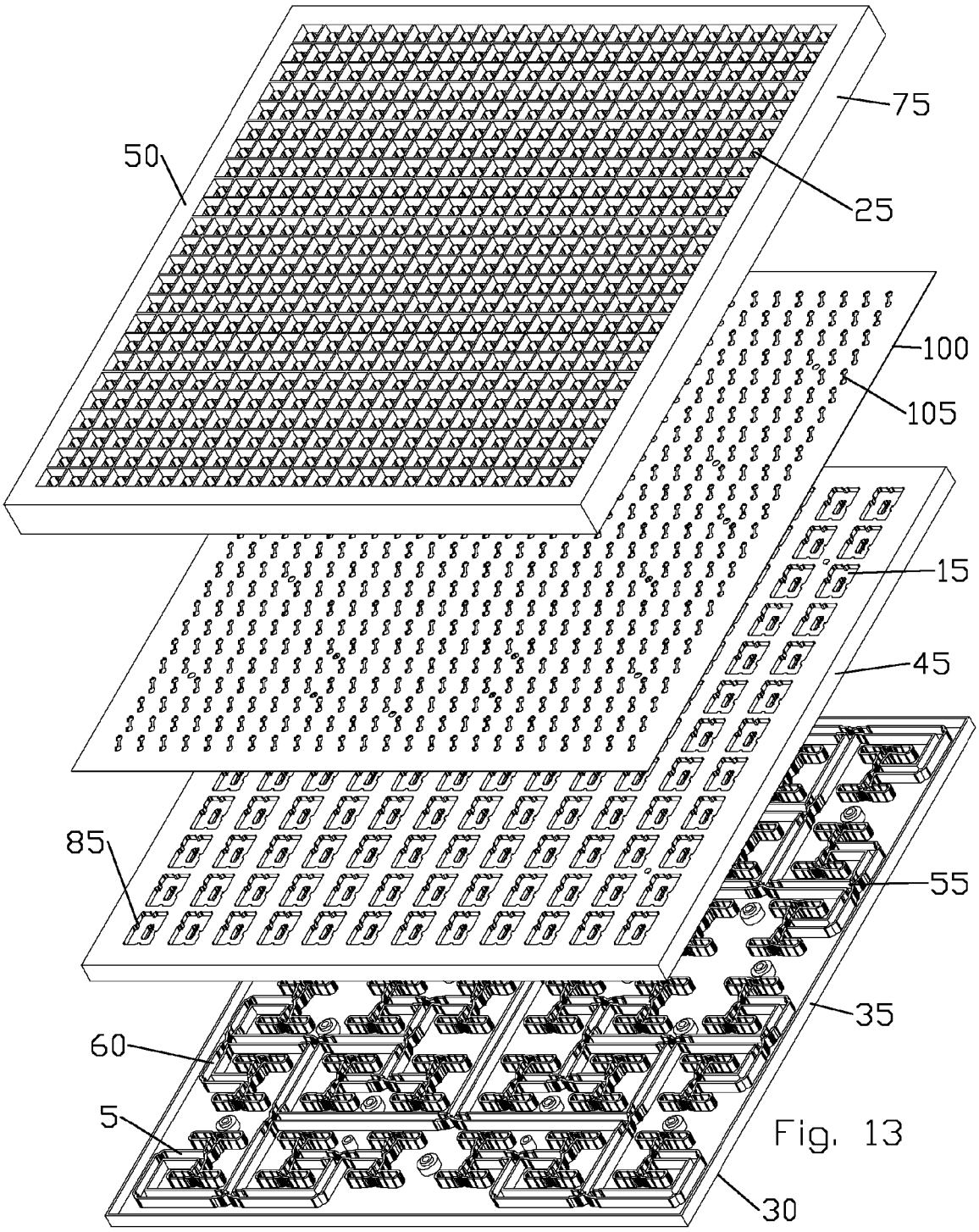
FIG. 13 is a schematic isometric exploded view of FIG. 11.
Figure 14:
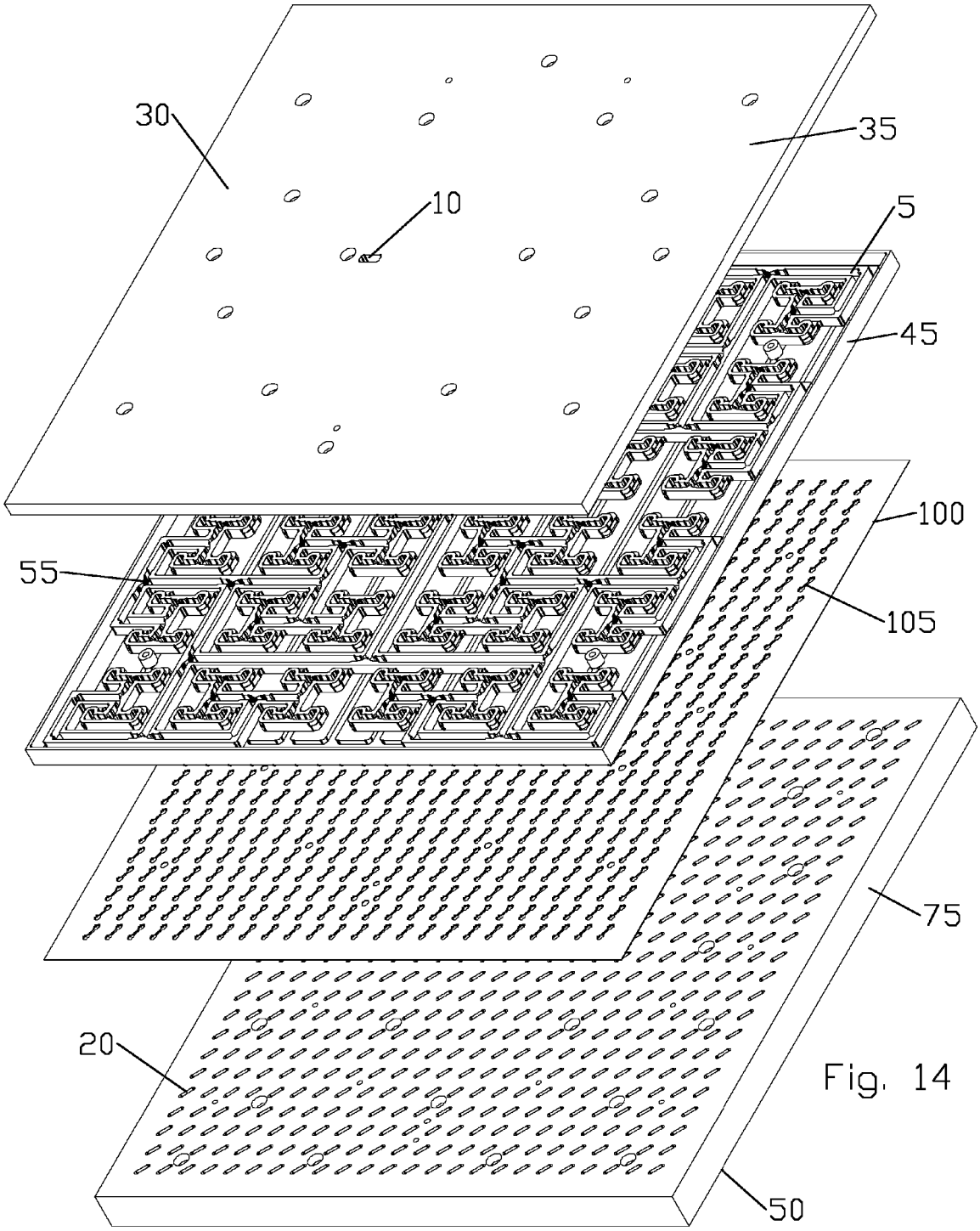
FIG. 14 is a schematic isometric exploded view of FIG. 12.
Figure 15:
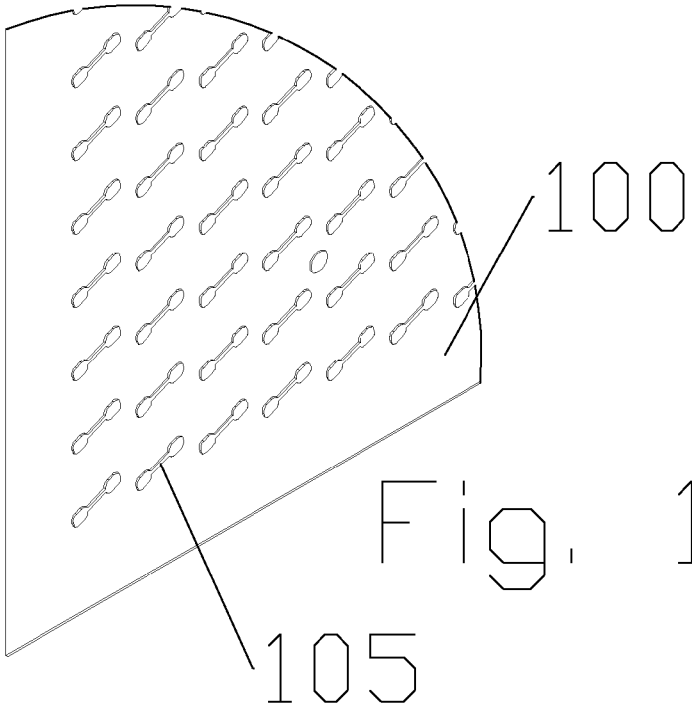
FIG. 15 is a close-up view of the slot layer of FIG. 13.
Figure 26:
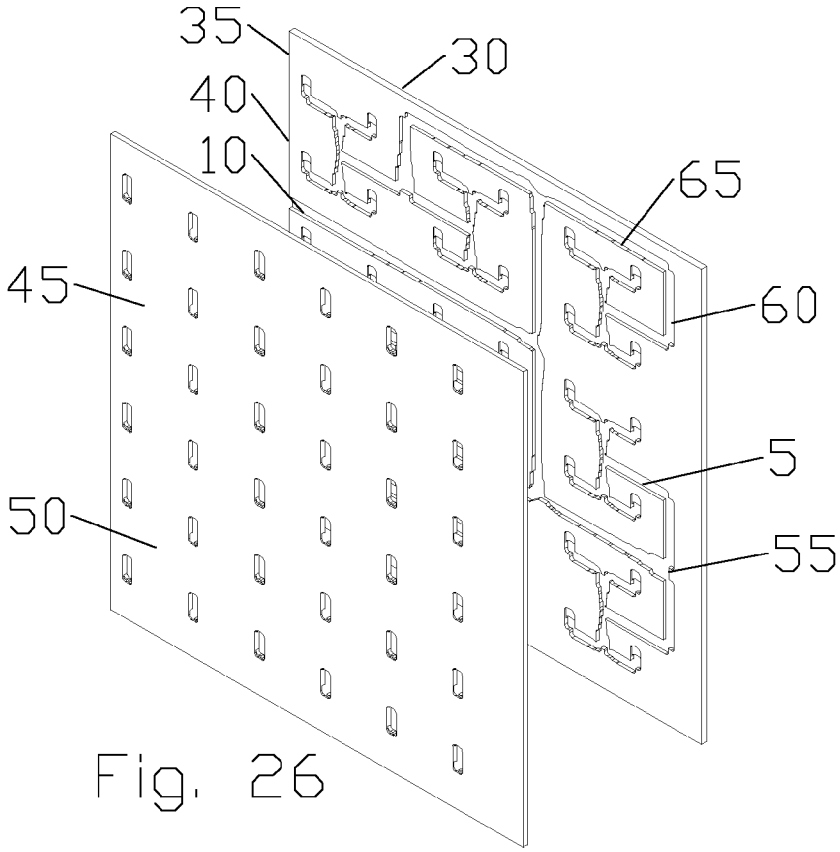
FIG. 26 is a schematic isometric view of an input layer and first intermediate layer demonstrating an E-plane waveguide network with an input feed at a layer sidewall.
Figure 27:
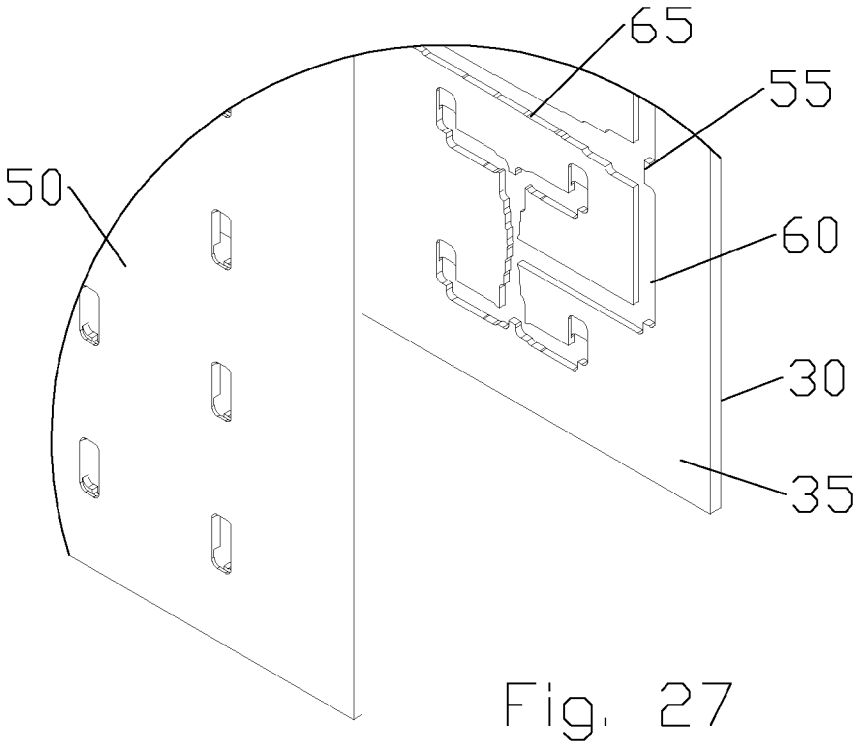
FIG. 27 is a close-up view of FIG. 26.

The waveguide network 5 may be provided with a rectangular waveguide cross section, a long axis of the rectangular cross section normal to a surface plane of the input layer 35 (see FIG. 6). Alternatively, the waveguide network 5 may be configured wherein a long axis of the rectangular cross section is parallel to a surface plane of the input layer 35 (see FIGS. 25-26). A seam 70 between the input layer 35 and the first intermediate layer 45 may be applied at a midpoint of the waveguide cross section, as shown for example in FIG. 6. Thereby, any leakage and/or dimensional imperfections appearing at the layer joint are at a region of the waveguide cross section where the signal intensity is minimized. Further, any sidewall draft requirements for manufacture of the layers by injection molding mold separation may be minimized, as the depth of features formed in either side of the layers is halved. Alternatively, the waveguide network 5 may be formed on the second side 50 of the input layer 35 or the first side 30 of the first intermediate layer 45 with the waveguide features at full waveguide cross-section depth in one side or the other, and the opposite side operating as the top or bottom sidewall, closing the waveguide network 5 as the layers are seated upon one another (see FIGS. 9 and 10).

Figure 23:
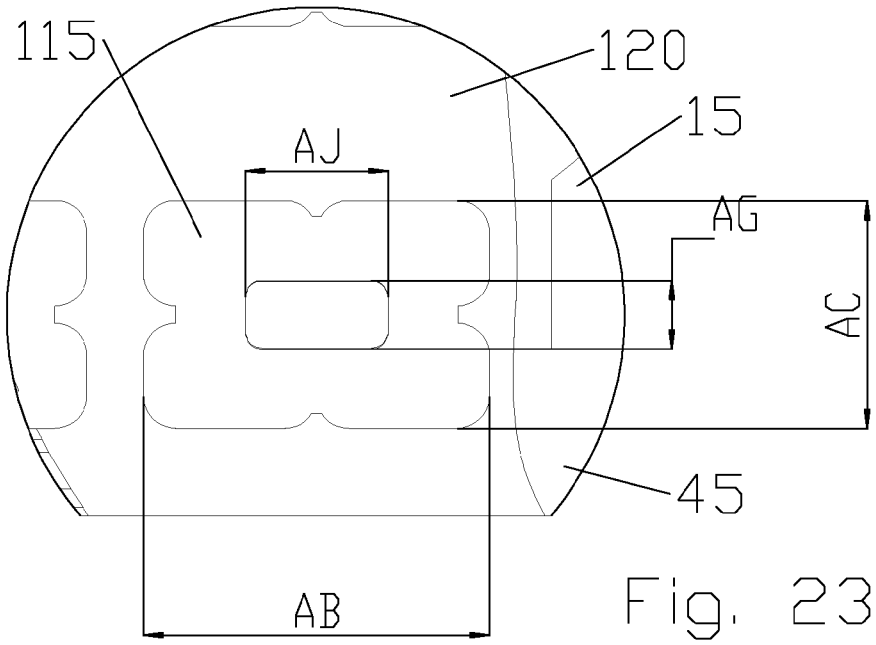
FIG. 23 is a close-up view of FIG. 22, with dimensional references for a coupling cavity.
Figure 24:
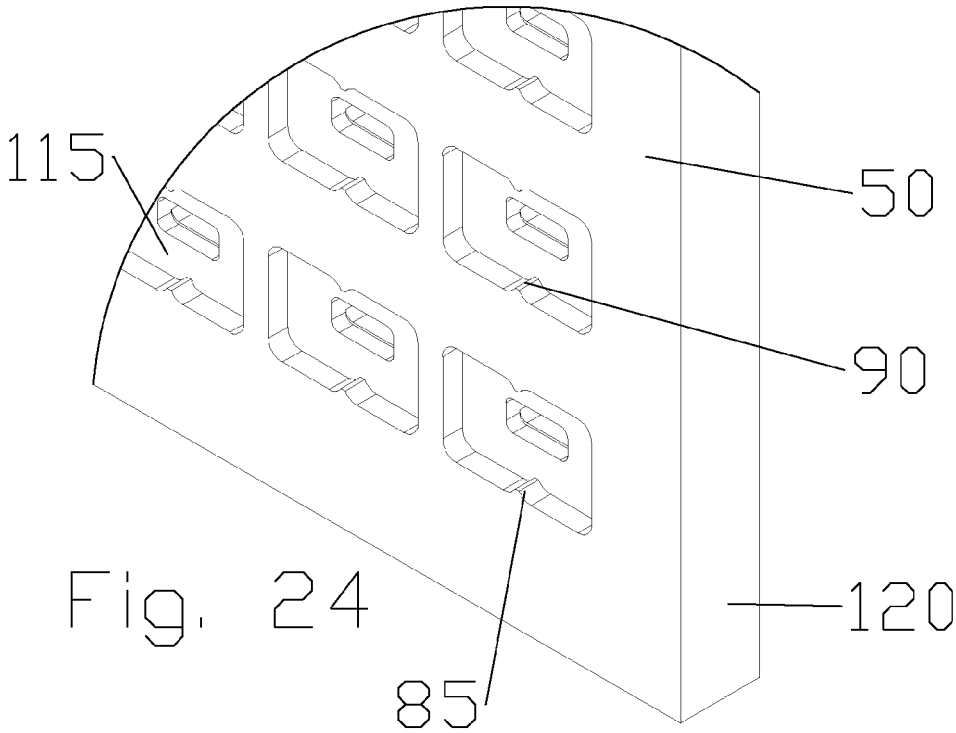
FIG. 24 is a schematic isometric close-up view of the second side of an alternative second intermediate layer.

The primary coupling cavities 15, each fed by a connection to the waveguide network 5, provide −6 dB coupling to four output ports 20. The primary coupling cavities 15 have a rectangular configuration with the waveguide network connection and the four output ports 20 on opposite sides. The output ports 20 are provided on a first side 30 of an output layer 75, each of the output ports 20 in communication with one of the horn radiators 25, the horn radiators 25 provided as an array of horn radiators 25 on a second side 50 of the output layer 75. The sidewalls 80 of the primary coupling cavities 15 and/or the first side 30 of the output layer 75 may be provided with tuning features 85 such as septums 90 projecting into the primary coupling cavities 15 or grooves 95 forming a depression to balance transfer between the waveguide network 5 and the output ports 20 of each primary coupling cavity 15. The tuning features 85 may be provided symmetrical with one another on opposing surfaces (see FIG. 23) and/or spaced equidistant between the output ports 20.

Figure 22:
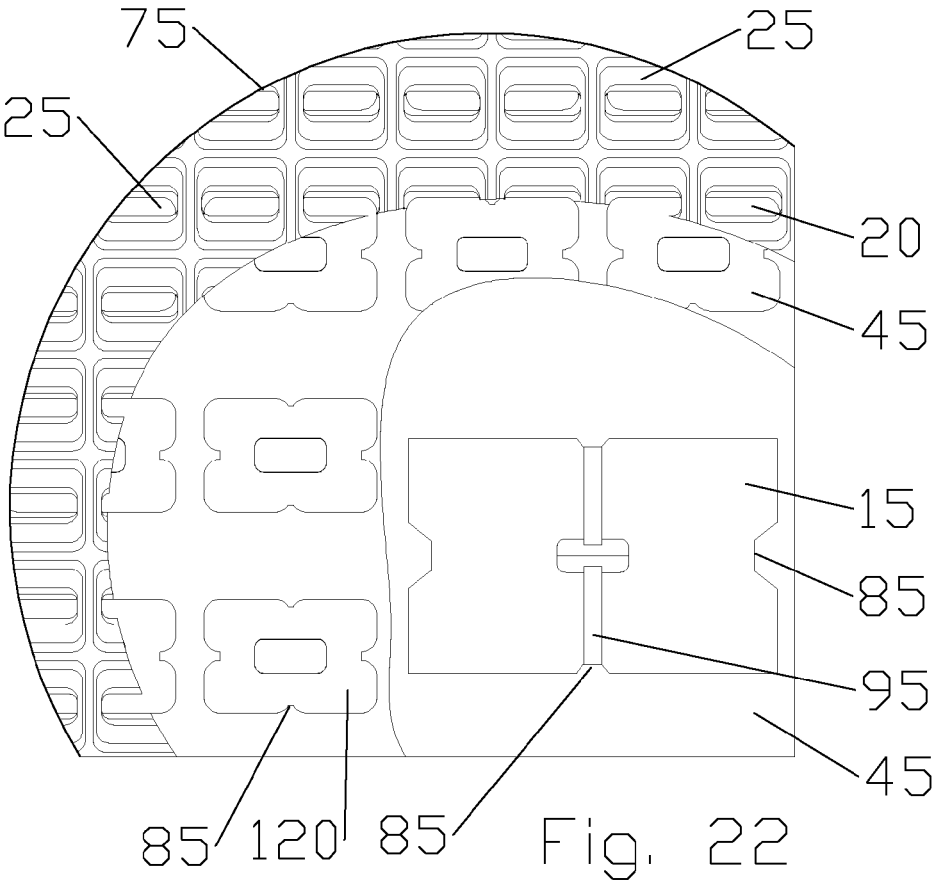
FIG. 22 is a close-up partial cut away front view of FIG. 18.

To balance coupling between each of the output ports 20, each of the output ports 20 may be configured as rectangular slots run parallel to a long dimension of the rectangular cavity, AB, and the input waveguide, AJ (see FIG. 22). Similarly, the short dimension of the output ports 20 may be aligned parallel to the short dimension of the cavity, AC, which is parallel to the short dimension of the input waveguide, AG.

When using array element spacing of between 0.75 and 0.95 wavelengths to provide acceptable array directivity, with sufficient defining structure between elements, a cavity aspect ratio, AB:AC may be, for example, 1.5:1.

An exemplary cavity may be dimensioned with:

a depth less than 0.2 wavelengths, a width, AC, close to n×wavelengths, and a length, AB, close to n×3/2 wavelengths.

The exemplary embodiment provides output signals with the same polarization orientation as delivered to the input feed 10. In further embodiments, for example as shown in FIGS. 11-17, the signal path may include polarization rotation, for example by inserting a slot layer 100 between the first intermediate layer 45 and the output layer 75. The slot layer 100 is provided with a plurality of dumbbell-shaped slots 105 (see FIG. 15), one of the slots 105 aligned with each of the output ports 20. A dumbbell-shaped slot 105 is a generally rectangular slot with end portions which extend away from the longitudinal axis of the slot 105, similar in appearance to the profile of the common weight training apparatus, a dumbbell. The slots 105 may be aligned at one half of a desired rotation angle, with respect to a longitudinal axis of the primary coupling cavities 15, and the output ports 20 further rotated one half the desired rotation angle with respect to a longitudinal axis of the slots 105. One skilled in the art will appreciate that the number of slot layers 100 may be increased, with the division of the desired rotation angle further distributed between the additional slot layers 100.

Where the desired rotation angle is 45 degrees with respect to the polarization at the input feed 10, the flat panel antenna 1 may be then mounted in a "diamond" orientation, rather than "square" orientation (with respect to the azimuth axis) and benefit from improved signal patterns, particularly with respect to horizontal or vertical polarization as the diamond orientation maximizes the number of horn radiators along each of these axes while using the advantages of the array factor.

Figure 16:
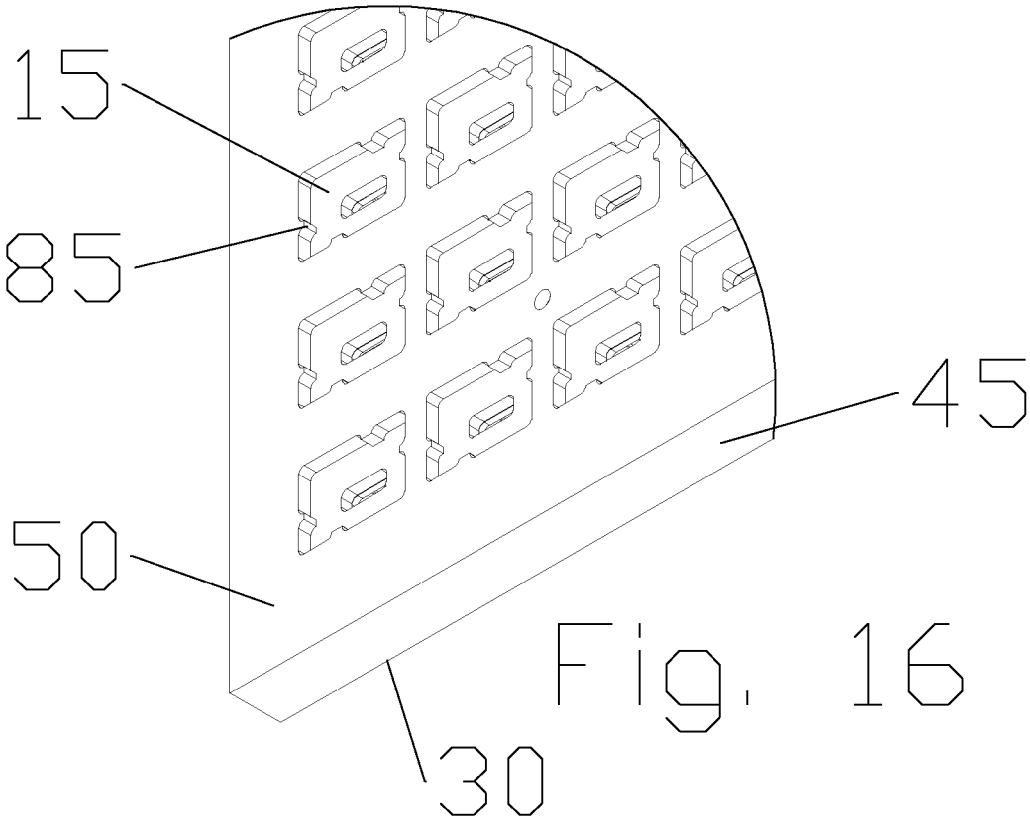
FIG. 16 is a close-up view of the second side of the intermediate layer of FIG. 13.
Figure 17:
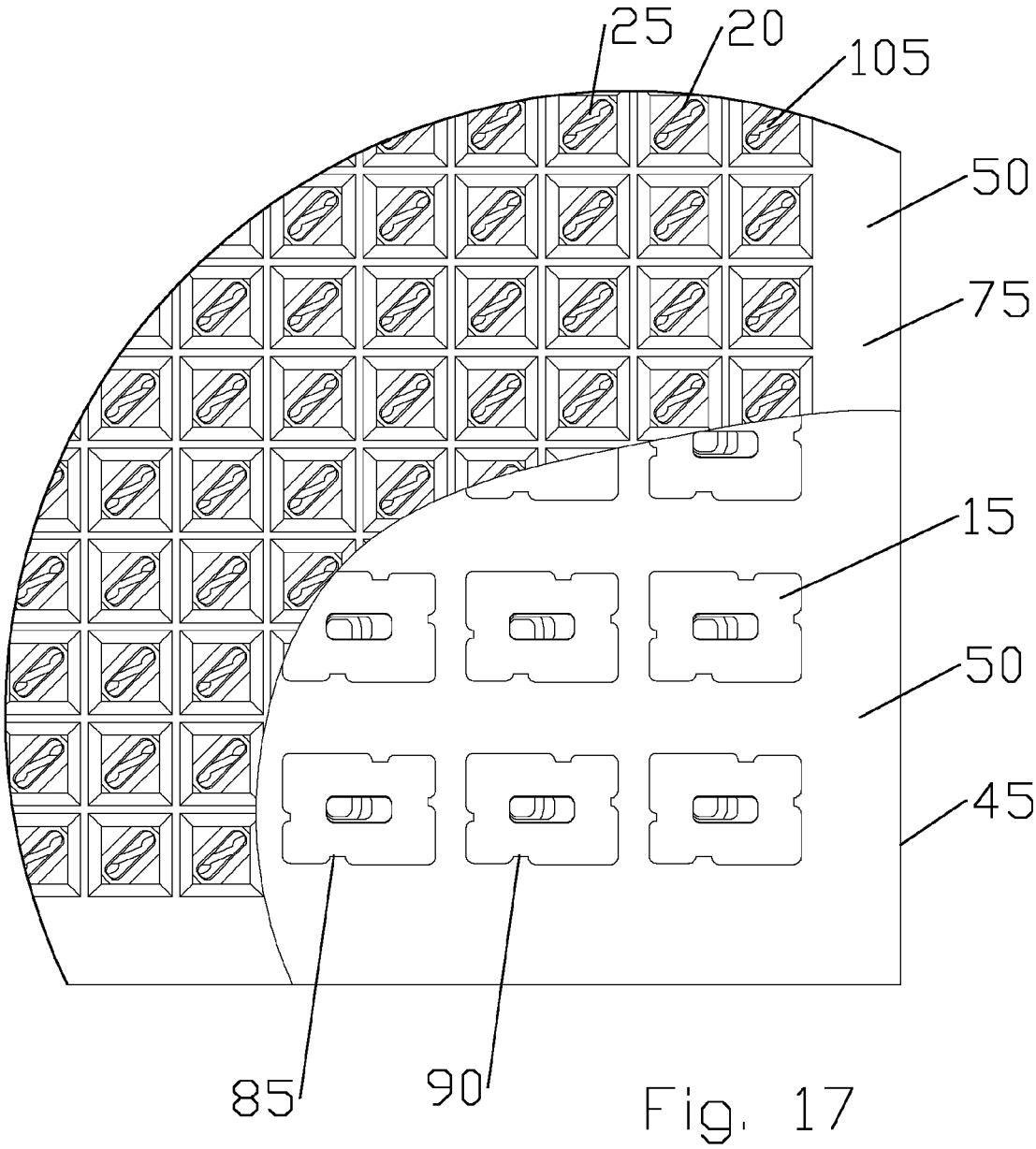
FIG. 17 is a close-up partial cut away front view of FIG. 11.
Figure 18:
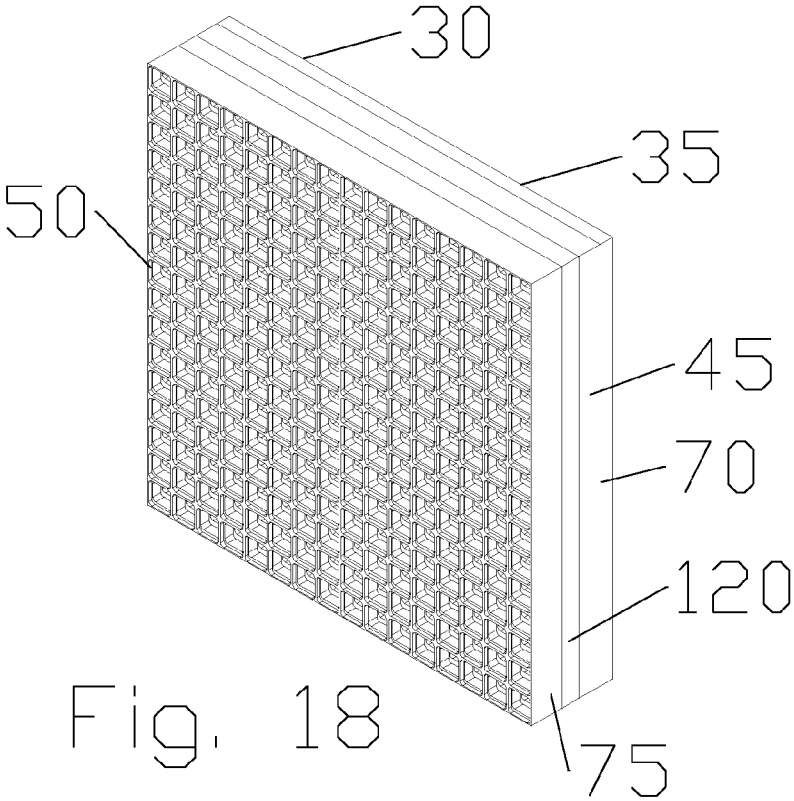
FIG. 18 is a schematic isometric angled front view of an exemplary second intermediate layer embodiment of a flat panel antenna.

To assist with signal routing to off axis dumbbell slots 105, tuning features 85 of the primary coupling cavity 15 may similarly be shifted into an asymmetrical alignment weighted toward ends of adjacent dumbbell slots 105, as shown for example in FIG. 16.

Further simplification of the waveguide network 5 may be obtained by applying additional layers of coupling cavities. For example, instead of being coupled directly to the output ports 20, each of the primary coupling cavities 15 may feed intermediate ports 110 coupled to secondary coupling cavities 115 again each with four output ports 20, each of the output ports 20 coupled to a horn radiator 25. Thereby, the horn radiator 25 concentration may be increased by a further factor of 4 and the paired primary and secondary coupling cavities 15, 115 result in −12 dB coupling (−6 dB/coupling cavity), comparable to an equivalent corporate waveguide network, but which significantly reduces the need for extensive high density waveguide layout gyrations required to provide equivalent electrical lengths between the input feed 10 and each output port 20.

Figure 19:
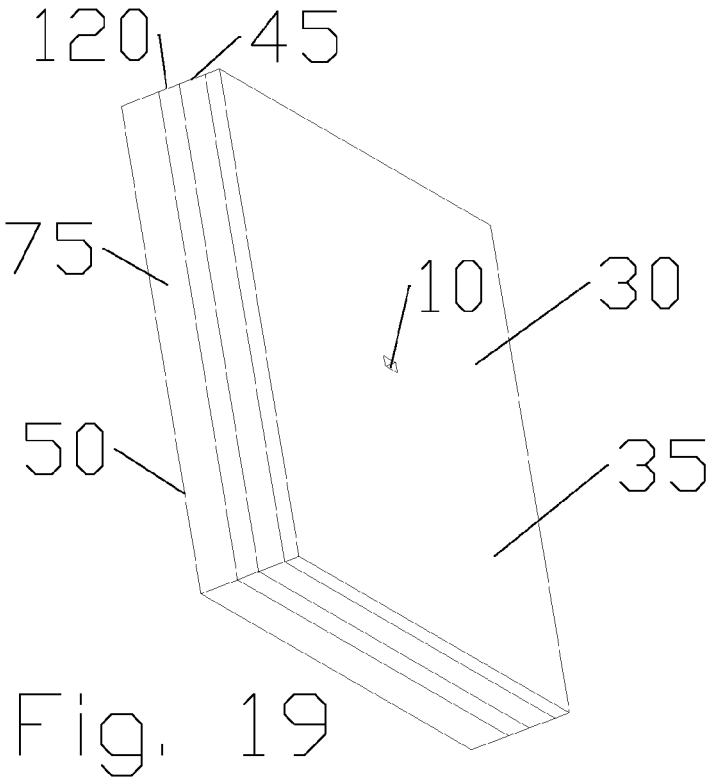
FIG. 19 is a schematic isometric angled back view of the flat panel antenna of FIG. 18.
Figure 20:
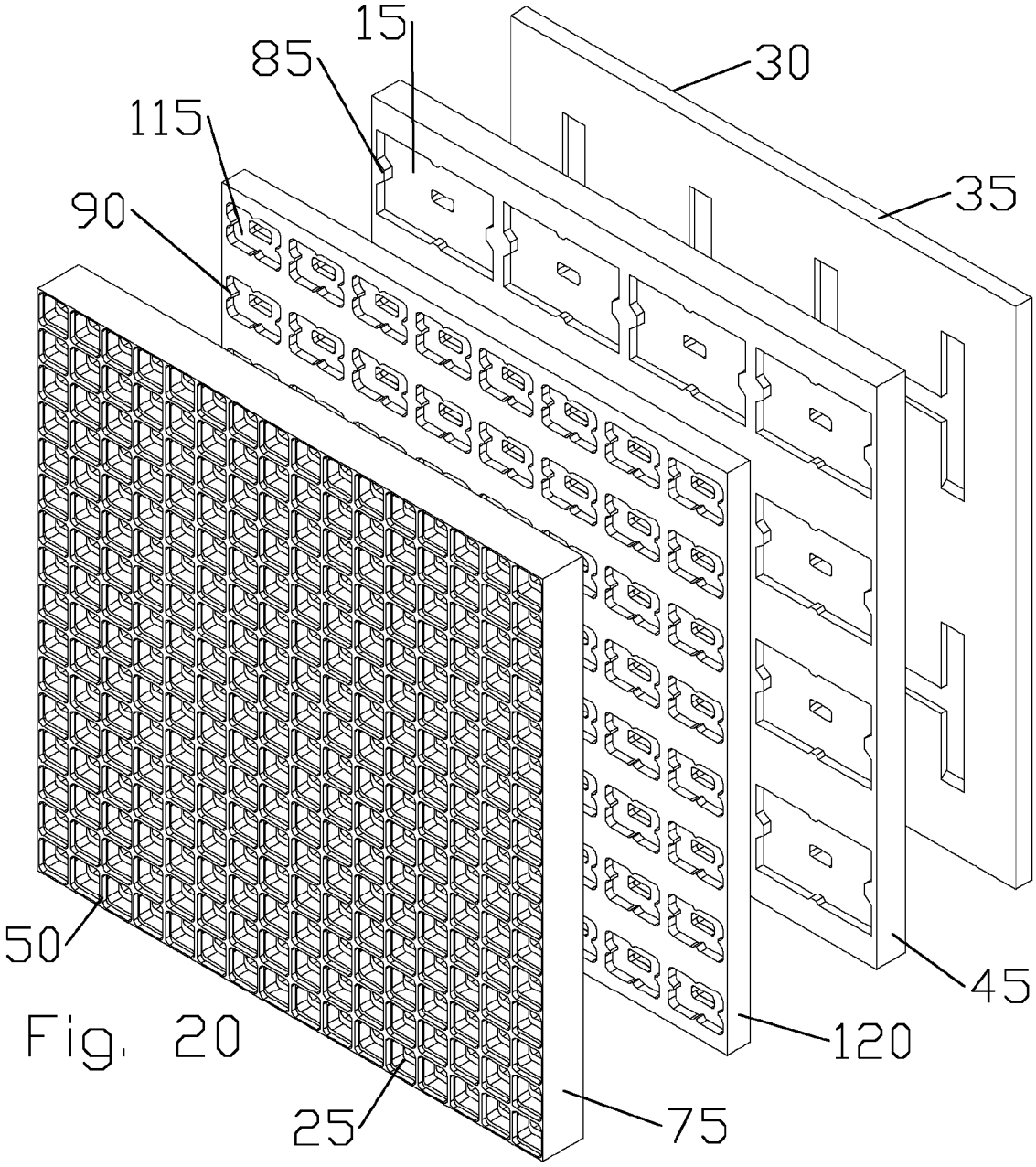
FIG. 20 is a schematic isometric exploded view of FIG. 18.
Figure 21:
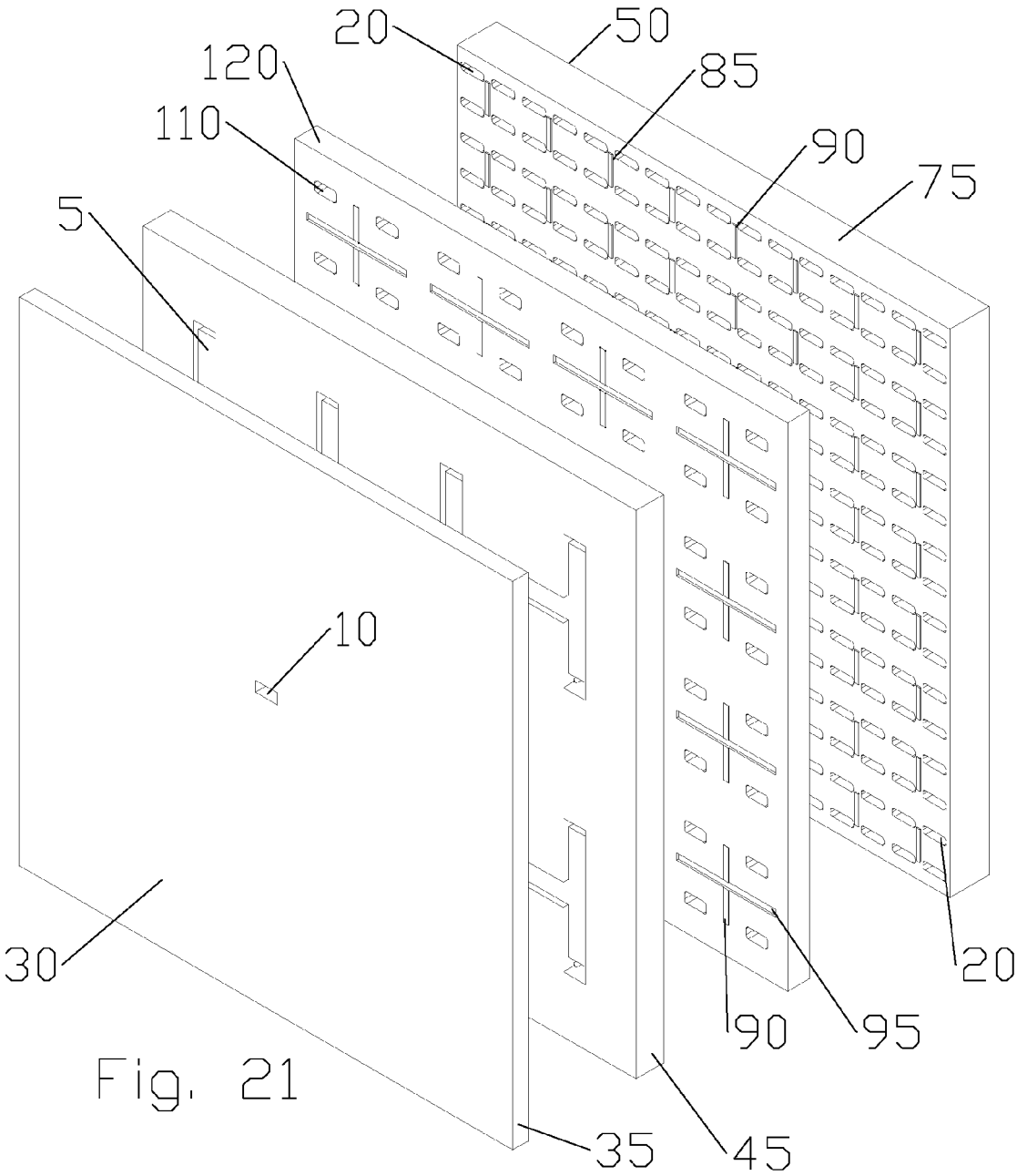
FIG. 21 is a schematic isometric exploded view of FIG. 19.

As shown for example in FIGS. 19 and 20, the waveguide network 5 may be similarly formed on a second side 50 of an input layer 35 and a first side 30 of a first intermediate layer 45. The primary coupling cavities 15 are again provided on a second side 50 of the first intermediate layer 45. Intermediate ports 110 are provided on a first side 30 of a second intermediate layer 120, aligned with the primary coupling cavities 15. The secondary coupling cavities 115 are provided on a second side 50 of the second intermediate layer 120, aligned with the output ports 20 provided on the first side 30 of the output layer 75, the horn radiators 25 provided as an array of horn radiators 25 on a second side 50 of the output layer 75. Tuning features 85 may also be applied to the secondary coupling cavities 115, as described with respect to the primary coupling cavities 15, herein above.

Alternatives described herein above with respect to the split of the waveguide network 5 features between adjacent layer sides may be similarly applied to the primary and/or secondary coupling cavities 15,115. For example, the midwall of the coupling cavities may be applied at the layer joint, a portion of the coupling cavities provided in each side of the adjacent layers.

In an embodiment having primary and secondary coupling cavities 15,115, the dimensions of the primary coupling cavity 15 may be, for example, approximately 3×2×0.18 wavelengths, while the dimensions of the secondary coupling 115 may be 1.5×1×0.18 wavelengths.

The array of horn radiators 25 on the second side 50 of the output layer 75 improves directivity (gain), with gain increasing with element aperture until element aperture increases past one wavelength and grating lobes begin to be introduced. One skilled in the art will appreciate that because each of the horn radiators 20 is individually coupled in phase to the input feed 10, the prior low density ½ wavelength output slot spacing typically applied to follow propagation peaks within a common feed waveguide slot configuration has been eliminated, allowing closer horn radiator 20 spacing and thus higher overall antenna gain.

Because an array of small horn radiators 20 with common phase and amplitude are provided, the amplitude and phase tapers observed in a conventional single large horn configuration that may otherwise require adoption of an excessively deep horn or reflector antenna configuration have been eliminated.

One skilled in the art will appreciate that the simplified geometry of the coupling cavities and corresponding reduction of the waveguide network requirements enables significant simplification of the required layer surface features which reduces overall manufacturing complexity. For example, the input, first intermediate, second intermediate (if present), slot (if present) and output layers 35,45,120,100,75 may be formed cost effectively with high precision in high volumes via injection molding and/or die-casting technology. Where injection molding with a polymer material is used to form the layers, a conductive surface may be applied.

Although the coupling cavities and waveguides are described as rectangular, for ease of machining and/or mold separation, corners may be radiused and/or rounded in a trade-off between electrical performance and manufacturing efficiency.

As frequency increases, wavelengths decrease. Therefore, as the desired operating frequency increases, the physical features within a corporate waveguide network, such as steps, tapers and T-type power dividers, become smaller and harder to fabricate. As use of the coupling cavities simplifies the waveguide network requirements, one skilled in the art will appreciate that higher operating frequencies are enabled by the present flat panel antenna, for example up to 26 GHz, above which the required dimension resolution/feature precision may begin to make fabrication with acceptable tolerances cost prohibitive.

From the foregoing, it will be apparent that the present invention brings to the art a high performance flat panel antenna with reduced cross section that is strong, lightweight and may be repeatedly cost efficiently manufactured with a very high level of precision.

Table of Parts

| | |
|---|---|
| 1 | flat panel array antenna |
| 5 | waveguide network |
| 10 | input feed |
| 15 | primary coupling cavity |
| 20 | output port |
| 25 | horn radiator |
| 30 | first side |
| 35 | input layer |
| 40 | layer sidewall |
| 45 | first intermediate layer |
| 50 | second side |
| 55 | T-type power divider |
| 60 | waveguide sidewalls |
| 65 | surface features |
| 70 | seam |
| 75 | output layer |
| 80 | sidewall |
| 85 | tuning feature |
| 90 | septum |
| 95 | groove |
| 100 | slot layer |
| 105 | slot |
| 110 | intermediate port |
| 115 | secondary coupling cavity |
| 120 | second intermediate layer |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A panel array antenna, comprising:

a waveguide network coupling an input feed to a plurality of primary coupling cavities;

each of the primary coupling cavities provided with four output ports, each of the output ports coupled to a horn radiator;

the waveguide network provided on a second side of an input layer and a first side of a first intermediate layer;

the primary coupling cavities provided on a second side of the first intermediate layer;

the output ports provided on a first side of an output layer, each of the output ports in communication with one of the horn radiators; and the horn radiators provided as an array of horn radiators on a second side of the output layer.

2. The panel array antenna of claim 1, wherein the input feed is provided on a first side of the input layer.

3. The panel array antenna of claim 1, wherein the input feed is provided on a layer sidewall between the input layer and the first intermediate layer.

4. The antenna of claim 1, further including a plurality tuning features provided on the first side of the output layer;

the tuning features provided for each of the primary coupling cavities.

5. The antenna of claim 1, further including at least one tuning feature located on at least one sidewall of each primary coupling cavity.

6. The antenna of claim 1, wherein the primary cavities are rectangular.

7. The antenna of claim 1, wherein the waveguide network has a rectangular cross section, a long axis of the rectangular cross section normal to a surface plane of the input layer.

8. The antenna of claim 1, wherein the waveguide network has a rectangular cross section, a long axis of the rectangular cross section parallel to a surface plane of the input layer.

9. The antenna of claim 1, further including a slot layer between the first intermediate layer and the output layer;

the slot layer provided with a plurality of dumbbell-shaped slots, one of the slots aligned with each of the output ports;

the slots rotated one half a desired rotation angle with respect to a longitudinal axis of the primary coupling cavities; and the output ports rotated one half the desired rotation angle with respect to a longitudinal axis of the slots.

10. A panel array antenna, comprising:

a waveguide network coupling an input feed to a plurality of primary coupling cavities;

each of the primary coupling cavities provided with four intermediate ports, each of the intermediate ports coupled to a secondary coupling cavity with four output ports, each of the output ports coupled to a horn radiator;

the waveguide network formed on a second side of an input layer and a first side of a first intermediate layer;

the primary coupling cavities provided on a second side of the first intermediate layer;

the intermediate ports provided on a first side of a second intermediate layer;

the secondary coupling cavities provided on a second side of the second intermediate layer;

the output ports provided on a first side of an output layer; and the horn radiators provided as an array of horn radiators on a second side of the output layer.

11. The panel array antenna of claim 10, wherein the input feed is provided on a first side of the input layer.

12. The panel array antenna of claim 10, wherein the input feed is provided on a layer sidewall between the input layer and the first intermediate layer.

13. The antenna of claim 10, further including a plurality of tuning features provided on the first side of the second intermediate layer and a first side of the output layer;

the tuning features provided on the first side of the second intermediate layer aligned with each of the primary coupling cavities and the tuning features of the first side of the output layer aligned with each of the secondary coupling cavities.

14. The antenna of claim 10, wherein the primary cavities are rectangular.

15. The antenna of claim 10, further including at least one side wall tuning feature located on at least one sidewall of each of the primary coupling cavity and at least one sidewall of each of the secondary coupling cavity.

16. A method for manufacturing a panel array antenna, comprising the steps of:

providing a waveguide network coupling an input feed to a plurality of primary coupling cavities;

each of the primary coupling cavities feeding four output ports, each of the output ports feeding a horn radiator;

the input feed provided on a first side of an input layer;

the waveguide network provided on a second side of the input layer and a first side of a first intermediate layer;

the primary coupling cavities provided on a second side of the first intermediate layer;

the output ports provided on a first side of an output layer, each of the output ports in communication with one of the horn radiators; and the horn radiators provided as an array of horn radiators on a second side of the output layer.

17. The method of claim 16, wherein the input, intermediate and output layers are formed by injection molding.

18. The method of claim 17, further including the step of applying a conductive surface to the input, intermediate and output layers.

19. The method of claim 16, wherein the input, intermediate and output layers are formed by die-casting.

20. The method of claim 16, further including the step of inserting a slot layer between the first intermediate layer and the output layer;

the slot layer provided with a plurality of dumbbell-shaped slots, one of the slots aligned with each of the output ports;

the slots rotated one half a desired rotation angle with respect to a longitudinal axis of the primary cavities; and providing the output ports rotated one half a desired rotation angle with respect to a longitudinal axis of the slots.

* * * * *